US007146123B2

(12) United States Patent
Kidaka

(10) Patent No.: US 7,146,123 B2
(45) Date of Patent: Dec. 5, 2006

(54) IMAGE FORMING APPARATUS

(75) Inventor: Hiroyuki Kidaka, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 215 days.

(21) Appl. No.: 11/019,135

(22) Filed: Dec. 22, 2004

(65) Prior Publication Data

US 2005/0180777 A1 Aug. 18, 2005

(30) Foreign Application Priority Data

Dec. 24, 2003 (JP) ..... 2003-427810

(51) Int. Cl.
*G03G 15/02* (2006.01)
*G03G 21/00* (2006.01)

(52) U.S. Cl. ..... 399/129; 399/174

(58) Field of Classification Search ..... 399/129, 399/174

See application file for complete search history.

(56) References Cited

U.S. PATENT DOCUMENTS

| | | | | |
|---|---|---|---|---|
| 5,835,821 | A | 11/1998 | Suzuki et al. | 399/100 |
| 6,459,872 | B1 | 10/2002 | Komiya et al. | 399/149 |
| 6,801,735 | B1 | 10/2004 | Komiya et al. | 399/149 |
| 2002/0191985 | A1 | 12/2002 | Komiya et al. | 399/149 |
| 2003/0228172 | A1* | 12/2003 | Nakamura et al. | 399/174 |

FOREIGN PATENT DOCUMENTS

| | | |
|---|---|---|
| JP | 9-96949 | 4/1997 |
| JP | 2001-92330 | 4/2001 |
| JP | 2002-196620 | 7/2002 |

* cited by examiner

*Primary Examiner*—Andrew H. Hirshfeld
*Assistant Examiner*—Amy He
(74) *Attorney, Agent, or Firm*—Fitzpatrick, Cella, Harper & Scinto

(57) ABSTRACT

An image forming apparatus includes an image bearing member, charging device which is in contact with the image bearing member and charges the image bearing member, development device which forms a toner image on the image bearing member and recovers a residual toner remaining after the transfer from the image bearing member, transfer device which transfers the toner image on the image bearing member onto a transfer material, auxiliary charging device which is positioned at a downstream side of the transfer device and at an upstream side of the charging device in a rotating direction of the image bearing member, which is in contact with the image bearing member and which is given a voltage of a polarity opposite to that of the developing toner, and voltage selecting device which selects the voltage applied to the auxiliary charging device based on the potential of the image bearing member after the transfer. In this manner, it is possible to prevent a defective image resulting from a voltage applied to the auxiliary charging device, regardless of a fluctuation of the potential on the photosensitive member after the transfer.

11 Claims, 7 Drawing Sheets

IMAGE FORMING APPARATUS

BACKGROUND OF THE INVENTION

1. Field of the Invention

The present invention relates to an image forming apparatus of a cleanerless system, in which development means recovers a transfer residual toner, which remains on an image bearing member after a transfer step, thereby dispensing with a cleaner. More particularly, it relates to an image forming apparatus of cleanerless system, provided with an image bearing member (charged member onto which charges are applied) such as an electrophotographic photosensitive member or an electrostatic recording dielectric member, contact charging means (contact charging apparatus or direct charging apparatus) of a contact type, which has a charging member in contact with the image bearing member and in which a charging bias is applied to the charging member thereby charging the image bearing member, information writing means which forms an electrostatic latent image on a charged surface of the image bearing member, development means which develops the electrostatic latent image with a toner to form a toner image, transfer means which transfers the toner image on the surface of the image bearing member onto a recording medium, and auxiliary charging means which is in contact with the surface of the image bearing member and applies a bias thereto thereby erasing a hysteresis of a preceding image, wherein the development means recovers a transfer residual toner, which remains on an image bearing member after a transfer step, thereby dispensing with a cleaner.

2. Related Background Art (a) Contact Charging Apparatus

In an image forming apparatus of an electrophotographic process or an electrostatic recording process, a corona charger has been commonly employed as charging means for charging an image bearing member such as an electrophotographic photosensitive member or an electrostatic recording dielectric member at predetermined polarity and potential. Such corona charger is positioned in non-contact manner, in an opposed relationship to the image bearing member (hereinafter referred to as photosensitive member) and a surface thereof is exposed to a corona emitted from the corona charger thereby charging the surface of the photosensitive member to predetermined polarity and potential. Recently, there is being adopted a charging apparatus of contact type, in which a charging member (contact charging member) with a voltage application (charging bias) is maintained in contact with the photosensitive member to charge the surface of the photosensitive member at predetermined polarity and voltage because of advantages such as a lower ozone generation and a lower electric power consumption in comparison with the corona charger of non-contact type. In particular, an apparatus of roller charging type, utilizing a charging roller (conductive roller) as a charging member, is employed advantageously in consideration of stability of charging.

Also an apparatus of magnetic brush charging method in which a magnetic brush charging member (charging magnetic brush, hereinafter represented as a magnetic brush charger) having a magnetic brush portion formed by magnetically capturing magnetic particles as a contact charging member and such magnetic brush portion is contacted with the photosensitive member is also advantageously employed in consideration of the stability of the charging apparatus. In such magnetic brush charger, a magnetic brush is formed by magnetically capturing conductive magnetic particles either directly on a magnetic member or on a sleeve incorporating a magnetic member, and the magnetic brush is contacted in a stationary or rotating state with a photosensitive member and is given a voltage to charge the photosensitive member.

Also a member of conductive fibers formed into a brush shape (fur brush charging member or charging fur brush) or a conductive rubber blade (charging blade) formed by conductive rubber in a blade shape is also employed advantageously as a contact charging member.

The contact charging includes two charging mechanisms, namely a charging method principally based on a charge injection (charge injection charging system) and a charging method principally based on a discharge (contact charging system), in a mixture, and, the characteristics of these systems are exhibited depending on which system is governing. A charge-injection charging system executes charging of the surface of the photosensitive member by a direct charge injection from the contact charging member into the photosensitive member. More specifically, a contact charging member of a medium resistance of $10^7$ to $10^{10}$ Ω·cm is contacted with the surface of the photosensitive member thereby executing a direct charge injection into the surface of the photosensitive member without principally relying on a discharge. Therefore, even in case a voltage applied to the contact charging member is lower than a discharge threshold value, the photosensitive member can be charged to a potential corresponding to the applied voltage. Such charge-injection charging system is not associated with an ozone generation by a discharge. However, in such charge-injection charging, the charging property is significantly influenced by the contact of the contact charging member with the photosensitive member. It is therefore required to form the contact charging member in a dense structure and to have a larger speed difference to the photosensitive member thereby obtaining a higher frequency of contact with the photosensitive member, and, in this respect, the magnetic brush charger can achieve a stable charging as a contact charging member.

The contact-charging discharge system charges the surface of the photosensitive member by discharge products resulting from a discharge phenomenon, generated in a small gap between a conduct charging member and the photosensitive member. In the corona charging, a voltage higher than the potential to be charged has to be applied to the contact charging member because a certain discharge threshold exists between the contact charging member and the photosensitive member, but this charging method shows discharge products significantly less than those in the corona charger and is simpler in configuration in comparison with the magnetic brush charger, thereby being advantageously employed.

(b) Cleanerless Process (Toner Recycling Process)

Image forming apparatuses have recently shown progresses in a compacter configuration, but the compactization of the entire image forming apparatus has a limitation by mere size reduction of means or devices of the image forming processes such as charging, exposure, development, transfer, fixation and cleaning. In the prior image forming process, a transfer residual toner remaining on the photosensitive member after the transfer step is collected as a waste toner by a cleaner (cleaning means) including a cleaning blade and a recovery container, but such waste toner is preferably absent also in consideration of the environmental protection.

Therefore, there is also realized an image forming apparatus of "cleanerless process" in which such exclusive cleaner is dispensed with and the residual toner on the photosensitive member is recovered by "recovery simultaneous with development" by development means and is re-used therein. The toner recovery simultaneous with development means a method of recovering the residual toner, remaining in a small amount on the photosensitive member after the transfer step, by a defogging bias (defogging potential difference $V_{back}$ between a DC voltage applied to the development means and a surface potential of the photosensitive member) at the development in a next or subsequent cycle.

This method, in which the transfer residual toner is recovered by the development means and is used in a next or subsequent cycle, can eliminate the waste toner and can alleviate the works that have been involved in the maintenance of the cleaner. Also the absence of the cleaner provides a significant advantage in the space and allows to significantly reduce the dimension of the image forming apparatus.

Also in case of a charging apparatus of contact charging type, the transfer residual toner having a charge amount not recoverable by the developing apparatus (such toner being hereinafter called reversal toner) is once recovered by the charging member maintained in contact with the photosensitive member, then is shifted to a charge of a polarity recoverable in the developing apparatus, again released onto the photosensitive member and recovered by the developing apparatus.

(c) Image Hysteresis Erasing Member

A transfer residual toner, remaining on the surface of the photosensitive member after the transfer of the toner image and present in a pattern of a previous image, if passed through the charging apparatus in this state, results in a decrease of the charged potential in a portion of the previous or an interception of the exposure for next image formation, and thus affects a next developing process in the form of such image thereby resulting in a phenomenon that the previous image appears denser or paler in a next image (such phenomenon hereinafter called a ghost phenomenon).

Therefore, Japanese Patent Application Laid-open Nos. 2001-92330 and 2002-196620 propose an image forming apparatus equipped with an auxiliary charging member maintained in contact with the surface of the photosensitive member and applying a bias thereto, as an image hysteresis erasing member for erasing a residual hysteresis of the previous image. As such auxiliary charging member, a brush of conductive rayon fibers of a fiber length of 6 mm was contacted with the photosensitive member in a position between the transfer charger and the charging apparatus, and the brush was given a DC voltage of a positive polarity, opposite to the charging polarity of the toner and of the photosensitive member. This brush, when given a positive bias, effectively erases the hysteresis of the charged potential of the previous image, and the transfer residual toner is also perturbed by this brush. Such toner, upon being accumulated on the brush and reaching a limit amount, is returned in succession onto the photosensitive member. Thus, as the hysteresis of the previous image is already lost at the contact portion of the charging apparatus and the photosensitive member, the direct cause of ghost formation is eliminated.

However, in case the positive voltage applied to the aforementioned brush of conductive rayon (hereinafter called auxiliary charging brush) is excessively high, a contrast between the voltage applied to the auxiliary charging brush and a high potential portion on the photosensitive member after the transfer becomes excessively large to generate a discharge between the auxiliary charging brush and the photosensitive member, whereby, as a result, the transfer residual toner is charged by the auxiliary charging brush in a polarity opposite to the charging polarity at the development. In case the reversal toner generated by the auxiliary charging brush increases in amount, a large amount of the reversal toner is deposited on the charging member when it passes between the charging member and the photosensitive member.

The reversal toner deposited on the charging member is given a charge of a polarity same as that the of potential of the photosensitive member for example by a friction with the surface of the charging member at the charging nip or by a friction with the cleaning member of the charging apparatus, and is released onto the photosensitive member for avoiding the contamination of the charging member, but an increased deposited amount, resulting from an excessive generation of the reversal toner, exceeds the release amount from the charging member.

Consequently the toner is accumulated on the charging member, thereby leading to a defective charging of the charging member by a toner contamination, resulting in a fog in a developing area.

On the other hand, in case the voltage applied to the auxiliary charging brush becomes low, a contrast between the potential on the photosensitive member after the transfer and the voltage applied to the auxiliary charging brush is reduced, whereby the hysteresis of the previous image is not erased sufficiently and gives rise to a ghost phenomenon.

Therefore, the contrast between the voltage applied to the auxiliary charging brush and the potential on the photosensitive member after the transfer has to set at an appropriate value capable of avoiding the aforementioned drawback.

However, the potential of the photosensitive member after the transfer varies significantly depending on the image. For example, in an image with the image whose numbers of dots per unit area is high, the potential of the photosensitive member is about −300 V in average before the transfer, and becomes about −80 V after the transfer. On the other hand, in an image with the image whose numbers of dots per unit area is high, the potential of the photosensitive member is about −500 V in average before the transfer, and becomes about −250 V after the transfer. Therefore, in case the voltage applied to the auxiliary charging brush is constant regardless of the potential of the photosensitive member after the transfer, the aforementioned drawback may be experienced depending on the potential of the photosensitive member after the transfer. Particularly in case of image formations over a prolonged image, the electrostatic capacitance of the photosensitive member gradually increases to facilitate the retention of the potential of the previous image on the surface of the photosensitive member after the transfer, whereby an application of a constant brush bias expands the potential difference between the surface of the photosensitive member after the transfer and the auxiliary charging brush, and the toner tends to be charged in the polarity of the voltage applied to the auxiliary charging brush, depending on the potential of the photosensitive member after the transfer.

SUMMARY OF THE INVENTION

A purpose of the present invention is to provide an image forming apparatus capable of preventing formation of a defective image resulting from a voltage applied to auxiliary charging means, regardless of a fluctuation of a potential of the photosensitive member after the transfer.

Another purpose of the invention is to provide an image forming apparatus capable of preventing charging of the transfer residual toner in an opposite polarity by auxiliary charging means, regardless of a magnitude of the potential of the photosensitive member after the transfer.

A further purpose of the invention is to provide an image forming apparatus including an image bearing member; charging means which is in contact with the image bearing member for charging the same; development means which forms a toner image on the image bearing member and recovers a residual toner remaining after the transfer from the image bearing member; transfer means which transfers the toner image on the image bearing member onto a transfer material; auxiliary charging means which is positioned at a downstream side of the transfer means and at an upstream side of the charging means in a rotating direction of the image bearing member, which is in contact with the image bearing member and which is given a voltage of a polarity opposite to that of the developing toner; and voltage selecting means which selects the voltage applied to the auxiliary charging means based on the potential of the image bearing member after the transfer.

A still further purpose of the invention is to provide an image forming apparatus including an image bearing member; charging means which is in contact with the image bearing member for charging the same; development means which forms a toner image on the image bearing member and recovers residual toner remaining after a transfer from the image bearing member; transfer means which transfers the toner image on the image bearing member; auxiliary charging means which is positioned at a downstream side of the transfer means and at an upstream side of the charging means in a rotating direction of the image bearing member, which is in contact with the image bearing member and which is given a voltage of a polarity opposite to that of the developing toner; and voltage selecting means which selects the voltage applied to the auxiliary charging means based on output image information.

Still other purposes of the invention will become apparent from the following description.

DESCRIPTION OF THE PREFERRED EMBODIMENTS

In the following, embodiments of the present invention will be explained with reference to the accompanying drawings.

FIRST EXAMPLE

Figure 1:
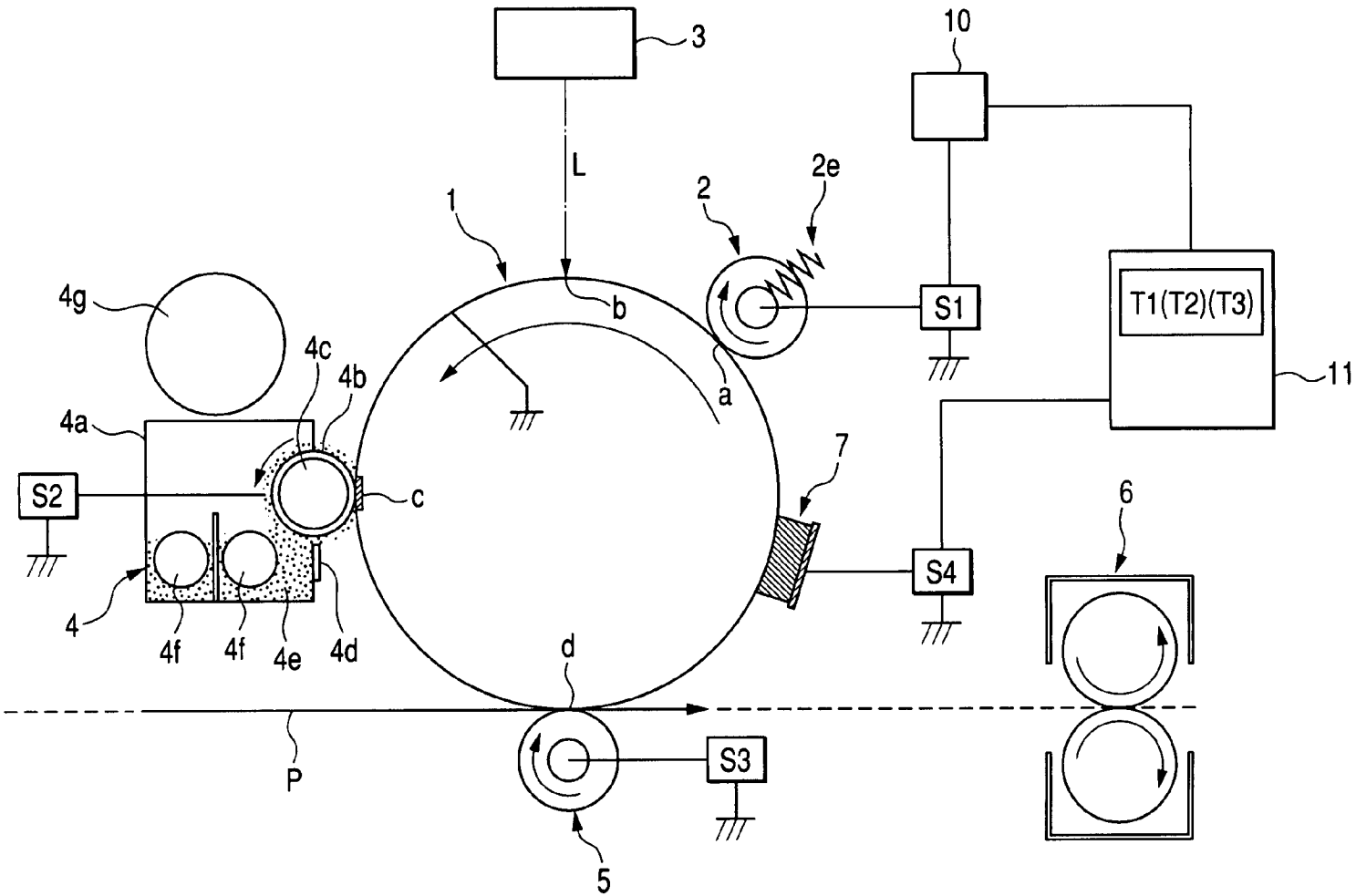
FIG. 1 is a schematic view showing a configuration of an image forming apparatus of an example 1.

FIG. 1 is a schematic view showing a configuration of an image forming apparatus embodying the present invention. The image forming apparatus of the present example is a laser beam printer based on a transfer-type electrophotographic process, a contact charging method, a reversal development and a cleanerless system, with a maximum sheet of A3 size.

(1) Schematic Configuration of Printer a) Image Bearing Member

1 indicates an electrophotographic photosensitive member 1 of a rotary drum shape (hereinafter represented as photosensitive drum), serving as an image bearing member. The photosensitive drum 1 is a negatively chargeable organic photoconductor (OPC), having an external diameter of 50 mm and is rotated counterclockwise, as indicated by an arrow, with a process speed (peripheral speed) of 100 mm/sec about a central axis.

Figure 2:
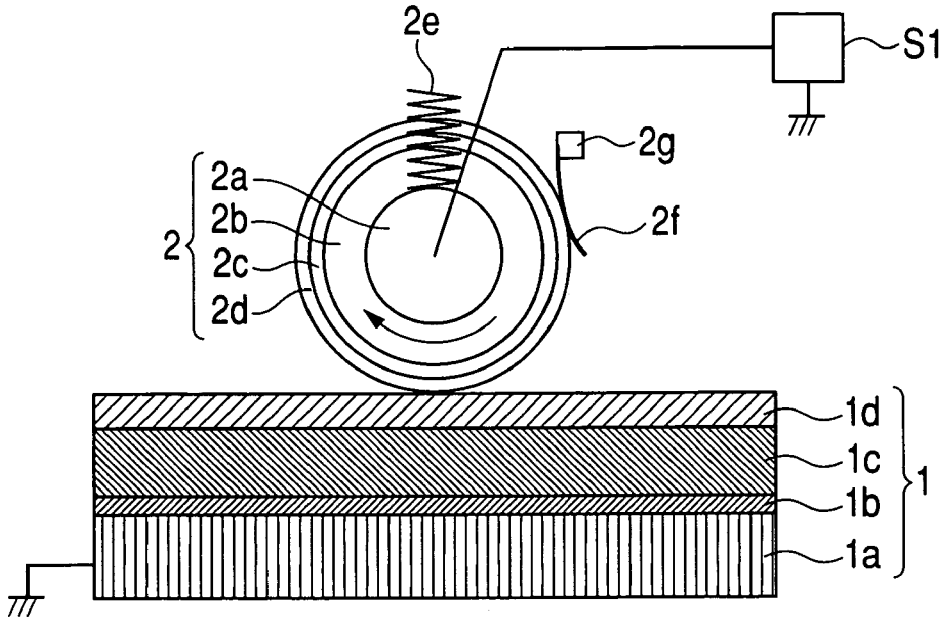
FIG. 2 is a schematic view showing a layer configuration of a photosensitive drum and a charging roller.

The photosensitive drum 1 is constituted, as schematically shown in a layer structure in FIG. 2, of an aluminum cylinder (conductive drum substrate) 1*a*, on which an undercoat layer 1*b* for suppressing optical interference and improving adhesion of an upper layer, a photocharge generating layer 1*c* and a charge transport layer 1*d* are coated in succession in this order.

b) Charging Means

2 indicates contact charging means (contact charger) for uniformly charging the periphery of the photosensitive drum 1, and is constituted in the present example of a charging roller (roller charger).

The charging roller 2 is rotatably supported at both ends of a metal core 2*a* by unillustrated bearing members, is biased and pressed by a pressure spring 2*e* to the surface of the photosensitive drum 1 under a predetermined pressure, and is rotated, following the rotation of the photosensitive drum 1. A contact portion of the photosensitive drum 1 and the charging roller 2 constitutes a charging portion a.

A bias voltage power source S1 applies a DC voltage of −600 V superposed with an alternating voltage of a peak-to-peak value of 1,200 V to the metal core 2*a* of the charging roller 2, thereby uniformly charging the surface of the rotating photosensitive drum 1 at a potential of −600 V. The power source S1 is variably controlled by discharge current control means 10 which detects a discharge current between the charging roller 2 and the photosensitive drum 1, so as to enable a charging with a necessary minimum current. The alternating voltage means any voltage having an amplitude varying with time, such as a sinusoidal wave, a square wave or a triangular wave.

The charging roller 2 has a length of 320 mm in the longitudinal direction, and has a three-layered structure including, as shown in FIG. 2, a lower layer 2*b*, an intermediate layer 2*c* and a surface layer 2*d* in succession in this order on a metal core (support member) 2*a*. The lower layer

2*b* is a foamed sponge layer for reducing a charging noise, and the surface layer 2*d* is a protective layer provided for preventing a leak even when the photosensitive drum 1 has a defect such as a pinhole.

More specifically, the charging roller 2 of the present example has following specification:

a. metal core 2*a*: a stainless steel rod of a diameter of 6 mm;

b. lower layer 2*b*: carbon-dispersed foamed EPDM, specific gravity: 0.5 g/cm$^3$, volumic resistivity: $10^2$ to $10^9$ Ω·cm, layer thickness: 3.0 mm, length: 320 mm;

c. intermediate layer 2*c*: carbon-dispersed NBR rubber, volumic resistivity: $10^2$ to $10^5$ Ω·cm, layer thickness: 700 μm;

d. surface layer 2*d*: fluorinine-containing Toresin resin in which tin oxide and carbon were dispersed to obtain a volumic resistivity of $10^7$ to $10^{10}$ Ω·cm, surface roughness (10 point averaged surface roughness Ra (JIS): 1.5 μm, layer thickness: 10 μm.

Referring to FIG. 2, a charging roller cleaning member 2*f* is constituted of a flexible cleaning film. The cleaning film 2*f* is positioned parallel to the longitudinal direction of the charging roller 2 and is fixed, at an end thereof, to a support member 2*g* which executes a predetermined reciprocating motion in the longitudinal direction, thus forming a contact nip with the charging roller 2.

The support member 2*g* is driven in a predetermined reciprocating motion in the longitudinal direction by a driving motor of the printer, through a gear train, whereby the surface layer 2*d* of the charging roller is rubbed by the cleaning film 2*f*. Thus contaminating substances (such as fine toner particles and external additives) on the roller surface 2*d* are eliminated.

c) Information Writing Means

3 indicates an exposure apparatus serving as information writing means for forming an electrostatic latent image on the charged surface of the photosensitive drum, and is constituted, in the present example, of a laser beam scanner utilizing a semiconductor laser. A modulated laser beam is emitted in response to an image signal transmitted from a host equipment such as an unillustrated image reading apparatus to the printer, and the uniformly charged surface of the rotating photosensitive drum 1 is subjected, at an exposure position b, to a laser scan exposure (imagewise exposure) L. Through such laser scan exposure, the surface of the photosensitive drum 1 shows a potential reduction in a portion irradiated with the laser beam, whereby an electrostatic latent image is formed in succession on the surface of the rotating photosensitive drum 1, corresponding to the image information of the scan exposure. In the present example, an exposure amount is so regulated that the potential reduction by the exposure has a lower limit of −210 V.

d) Development Means

4 indicates a developing apparatus (developing device) constituting development means which supplies the electrostatic latent image on the photosensitive drum 1 with a developer (toner) thereby rendering the electrostatic latent image visible. In the present example, it is constituted of a reversal developing apparatus of two-component magnetic brush developing method.

4*a* indicates a developing container and 4*b* indicates a non-magnetic developing sleeve. The developing sleeve 4*b* is provided rotatably in the developing container 4*a*, exposing a part of an external periphery to the exterior. There are also provided a magnet roller 4*c* provided in non-rotating manner inside the developing sleeve 4*b*, a developer coating blade 4*d*, a two-component developer 4*e* contained in the developing container 4*a*, a developer agitating member 4*f* provided at a bottom part of the developing container 4*a*, and a toner hopper 4*g* containing replenishing toner.

The two-component developer 4*e* in the developing container 4*a* is a mixture of a toner and a magnetic carrier, and is agitated by the developer agitating member 4*f*. In the present example, the magnetic carrier has a resistivity of about $10^{13}$ Ω·cm and a particle size of about 40 μm. The toner is negatively charged by a friction with the magnetic carrier.

The developing sleeve 4*b* is positioned close and opposed to the photosensitive drum 1, with a smallest distance (called S-D gap) of 350 μm. The opposed portion of the photosensitive drum 1 and the developing sleeve 4*b* constitutes a developing portion C.

The developing sleeve 4*b* is rotated in a direction opposite to the advancing direction of the photosensitive drum 1 in the developing portion c. On an external periphery of the developing sleeve 4*b*, a part of the two-component developer 4*e* in the developing container 4*a* is supported as a magnetic brush layer, by a magnetic attraction of the magnet roller 4 provided in the sleeve, then carried along the rotation of the sleeve, formed into a predetermined thin layer by the developer coating blade 4*d* and brought into contact, under suitable rubbing action, with the surface of the photosensitive drum 1 in the developing portion c.

The developing sleeve 4*b* is given a predetermined developing bias from a bias voltage source S2. In the present example, the developing bias to the developing sleeve 4*b* is a vibrating voltage formed by superposing a DC voltage (Vdc) and an AC voltage (Vac). More specifically, the vibrating voltage is formed by superposing:

DC voltage: −350 V

AC voltage: peak-to-peak value 1,600 V.

Then, within the developer coated as a thin layer on the rotating developing sleeve 4*b* and carried to the developing portion c, the toner is deposited onto the photosensitive drum 1 corresponding to the electrostatic latent image and under the influence of an electric field formed by the developing bias, whereby the electrostatic latent image is developed as a toner image. In the present example, the electrostatic latent image is reversal developed by toner deposition in an exposed portion on the surface of the photosensitive drum 1.

In this operation, the toner deposited on the photosensitive drum has a charge amount of −25 μC/g.

The toner of the present example has a negative charging polarity.

The thin developer layer on the developing sleeve 4*b*, after passing the developing portion c, is returned by the subsequent rotation of the developing sleeve to a developer reservoir in the developing container 4*a*.

In order to maintain a toner concentration, in the two-component developer 4*e* in the developing container 4*a*, within a predetermined range, such toner concentration in the two-component developer 4*e* in the developing container 4*a* is detected for example by an unillustrated optical toner concentration sensor, and the toner hopper 4*g* is controlled according to the information of such detection, whereby the toner in the toner hopper is replenished into the two-component developer 4*e* in the developing container 4*a*. The toner replenished into the two-component developer 4*e* is agitated by the agitating member 4*f*.

e) Transfer Means, Fixing Means

5 indicates transfer means, which is constituted of a transfer roller in the present example. The transfer roller 5 is pressed to the photosensitive drum 1 under a predetermined pressure, and a pressed nip constitutes a transfer portion d. A transfer material (transfer member or recording material) P constituting a recording medium is fed to such transfer portion d, at a predetermined timing from an unillustrated sheet supply mechanism.

The transfer material P fed to the transfer portion P is conveyed by pinching between the rotating photosensitive drum 1 and the transfer roller 5, during which a positive transfer bias (+2 kV in the present example) which is opposite to the normal negative polarity of the toner is applied from a bias voltage source S3 to the transfer roller 5, whereby the toner image is electrostatically transferred in succession from the surface of the photosensitive drum 1 onto the surface of the transfer material P conveyed in the transfer portion d.

The transfer material P, passing through the transfer portion d and receiving the toner image transfer, is separated in succession from the surface of the rotating photosensitive drum 1, and conveyed to the fixing apparatus 6 (for example a heat roller fixing apparatus) for fixation of the toner image, thereby being output as a formed image (print or copy).

The printer of the present example employs a cleanerless process and is not provided with an exclusive cleaner for eliminating the toner, not transferred onto the transfer material P in the transfer portion d but remaining on the surface of the rotating photosensitive drum 1. As will be explained later, the transfer residual toner reaches the position of the contact charging apparatus 2 by the subsequent rotation of the photosensitive drum 1, then temporarily deposited on the charging roller 2 constituting the contact charging member 2 in contact with the photosensitive drum 1, thereafter again released onto the photosensitive drum 1 and finally recovered in the developing apparatus 4, whereupon the photosensitive drum 1 is used again for image formation.

The auxiliary charging brush 7 is constituted of a brush of conductive rayon fibers of a length of 6 mm, maintained in contact with the photosensitive member. The conductive brush 7 is maintained in contact with the photosensitive drum in a position between the transfer means 5 and the charging roller 2, and is given an AC bias, a DC bias of a polarity opposite to that of charging, or a DC bias of a polarity opposite to that of charging superposed with an AC bias, thus averaging the surface potential of the photosensitive drum immediately before charging by the charging roller 2 and also temporarily capturing the transfer residual toner in the brush and then releasing the captured toner onto the photosensitive member again. In this operation, when the toner is accumulated on the brush surface, it reaches a limit holding amount and is returned in succession onto the photosensitive member.

(2) Operation Steps of Printer

Figure 9:
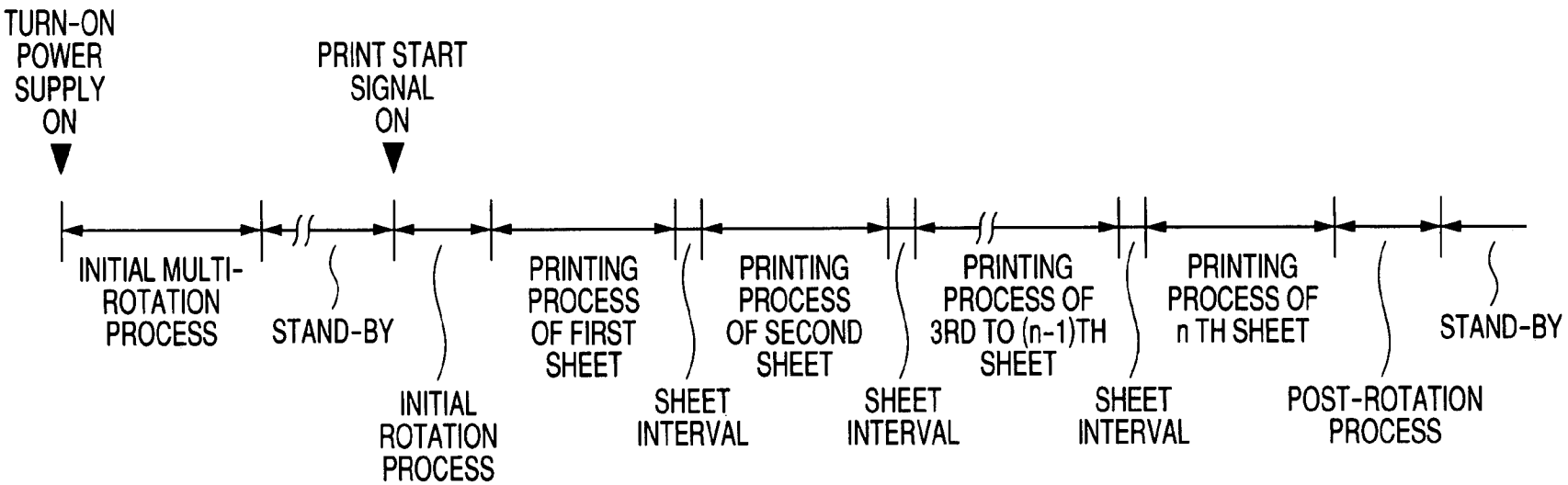
FIG. 9 is a view showing functions of an image forming apparatus.

In the following, the operation sequence of the above-described printer will be explained with reference to FIG. 9.

A. Initial Multi-Rotation Step

This is a period of a starting operation (start-up operation or warming period) of the printer. A main power switch is turned on to activate a main motor of the apparatus, thereby rotating the photosensitive drum 1 and causing to execute preparations in process devices.

B. Initial Rotation Step

This is a period of a pre-print operation. The initial rotation step is executed in succession to the initial multi-rotation step, in case a print signal is entered during the initial multi-rotation step. In the absence of the print signal, the main motor is once stopped after the initial multi-rotation step to terminate the rotation of the photosensitive drum 1. Then the printer is maintained in a stand-by state until the print signal is entered, and the initial rotation step is executed when the print signal is entered.

C. Print Step (Image Formation Step)

When the initial rotation step is terminated, there are executed an image forming process on the photosensitive drum 1, a transfer process of the toner image, formed on the photosensitive drum 1, onto the transfer material P and a fixing process of the toner image by the fixing means, whereby a printed image is output. In case of a continuous printing mode, the aforementioned print step is repeated for a preset print number.

D. Sheet Interval Step

This is a sheet not-passing period, in the continuous print mode, after the trailing end of a transfer material P passes the transfer nip portion d and before the leading end of a succeeding transfer sheet P reaches the transfer nip portion d. While an area of the photosensitive drum 1, which passes the transfer nip d in this period, previously passes the charging nip a, the AC component in the charging bias is interrupted whereby the transfer residual toner temporarily deposited on the charging roller is released onto the photosensitive drum 1.

E. Post Rotation Step

After the termination of the print step for the last transfer material P, the rotation of the main motor is continued for a while to continue the rotation of the photosensitive drum 1, thereby executing a predetermined post operation in this period. Also in this period, the AC component of the charging bias is interrupted as in the sheet interval step, whereby the transfer residual toner temporarily deposited on the charging roller is released onto the photosensitive drum 1.

F. Stand-by State

After the predetermined post rotation step is completed, the main motor is stopped to terminate the rotation of the photosensitive drum, and the printer is maintained in a stand-by state until a next print start signal is entered.

In case of a single print, the printer, after such print, executes the post rotation step and enters the stand-by state. When a print start signal is entered in the stand-by state, the printer enters the initial rotation step.

The print step C is an image forming period, while the initial multi-rotation step A, the initial rotation step B and the sheet interval step D are image non-forming periods.

(3) Cleanerless System

As the printer of the present example is based on a cleanerless system, the toner (transfer residual toner), remaining on the photosensitive drum 1 after the toner image transfer onto the transfer material P, is carried to the charging nip a of the photosensitive drum 1 and is temporarily recovered by a deposition onto the charging roller 2. The transfer residual toner on the photosensitive drum 1 is often a mixture of a positively charged toner (reversal toner) and a negatively charged toner, caused for example by a peeling discharge at the transfer. The transfer residual toner having such mixed polarities reaches the charging roller 2 and is temporarily deposited thereon.

The deposition of the transfer residual toner onto the charging roller 2 is enhanced by an oscillating electric field generated by an application of an AC voltage to the charging roller 2, and in particular the reversal toner shows an enhanced deposition in comparison with the negatively charged toner. Among the transfer residual toner deposited on the charging roller, the negatively charged one is released onto the photosensitive drum 1 while the positively charged one remains on the surface of the charging roller 2 without being released.

The transfer residual toner of the normal polarity, released onto the photosensitive drum 1, reaches the developing portion c, and is recovered by a cleaning simultaneous with development, by a defogging electric field at the development by the developing sleeve 4*b* of the developing apparatus 4. In case an image area along the rotating direction is longer than the peripheral length of the photosensitive drum 1, such recovery simultaneous with development of the transfer residual toner proceeds simultaneous with the image forming steps such as charging, exposure, development and transfer. Therefore, the transfer residual toner is recovered into the developing apparatus 4 and is used again in the subsequent cycles, so that the waste toner can be eliminated. Also such system provides a significant advantage in the space, enabling a major dimensional reduction of the image forming apparatus.

Use of a highly releasing spherical toner formed by a polymerization method, as the toner 4*e* of the developer, allows to reduce the amount of the transfer residual toner and also to improve recovery of the toner, released from the charging roller 2, into the developing apparatus 4. Also the use of a developing apparatus 4 of two-component contact development type allows to improve recovery of the toner, released from the charging roller 2, into the developing apparatus 4.

Since the toner generally has a relatively high electrical resistance, the reversal toner deposited on the charging roller 2 and maintained thereon in the rotation without being released therefrom constitutes a factor of increasing the electrical resistance of the charging roller 2 thereby deteriorating the charging property thereof. Therefore, in case an amount of the deposited toner is relatively high, it is required to release a large amount of the toner in an image non-forming period thereby maintaining a satisfactory charging property.

Now the toner release will be briefly explained.

A toner deposition on the charging roller 2 gradually increases the electrical resistance in a deposited portion, which cannot achieve a sufficient charge transfer while passing through the charging nip a, whereby the photosensitive drum 1 after passing the charging nip a shows a surface potential in comparison with a portion without such toner deposition. In the following description, ΔV represents a potential difference between a portion with a toner deposition on the charging roller 2 and a portion without a toner deposition. In case the toner deposited on the charging roller 2 has a charge of a polarity same as that of the potential on the photosensitive member by a friction with the surface of the charging roller 2 at the charging nip a or by a friction with the charging roller cleaning member 2*f*, the deposited toner is released, by an electric field generated by the potential difference ΔV, from the charging roller 2 onto the surface of the photosensitive member. This phenomenon is utilized for example in a known method, as disclosed for example in Japanese Patent Application Laid-open No. H9-96949, of increasing the potential difference ΔV by reducing the amplitude Vpp of the AC component or terminating the AC component in the charging bias during an image non-forming period, thereby stimulating the toner release and suppressing the increase in the electrical resistance of the charging roller 2.

Such toner release in an image non-forming period may be executed for example in a sheet interval step or in a post rotation step after the image formation thereby maintaining the deposited toner amount on the charging roller 2 within a certain level even in a prolonged use.

(4) Auxiliary Charging Brush

Figure 7:
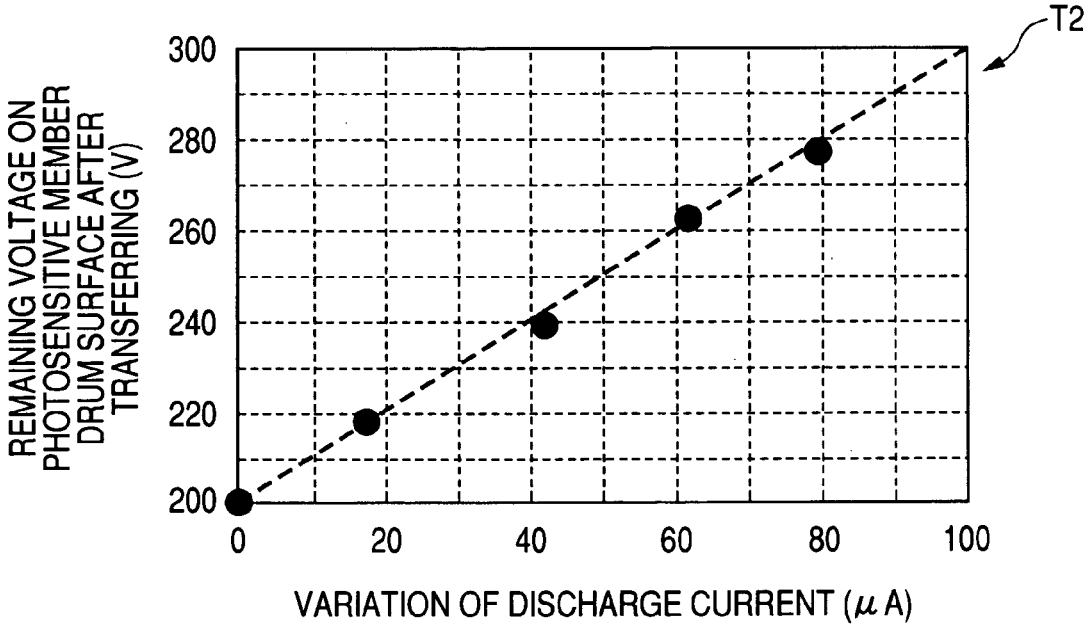
FIG. 7 is a chart of a conversion table indicating a relationship, in an image forming apparatus of an example 2, of a change in a discharge current between the image bearing member and the charging roller from the start of a sheet-passing durability test and a residual surface potential on the image bearing member after the transfer.

As explained in the foregoing in FIG. 7, the auxiliary charging brush 7 is maintained in contact with the photosensitive drum 1 in a position between the transfer means 5 and the charging roller 2, and is given an AC bias, a DC bias of a polarity opposite to that of charging, or a DC bias of a polarity opposite to that of charging superposed with an AC bias from a bias voltage source S4, thus averaging the surface potential of the photosensitive drum immediately before charging by the charging roller 2 and also temporarily capturing the transfer residual toner in the brush and then releasing the captured toner onto the photosensitive member again. In this operation, when the toner is accumulated on the brush surface, it reaches a limit holding amount and is returned in succession onto the photosensitive member. Thus, the auxiliary charging brush 7 constitutes auxiliary charging means which averages the hysteresis of the previous image and eliminates the direct cause of the ghost formation.

It is possible to maintain the toner amount, deposited on the charging roller 2, at a constant level by increasing the potential difference ΔV by reducing the amplitude Vpp of the AC component or terminating the AC component in the charging bias during an image non-forming period, thereby stimulating the toner release. However, in case the positive voltage applied to the auxiliary charging brush 7 is excessively high when the electrostatic capacitance of the photosensitive drum 1 increased for example in a later stage of image formation, an excessive positive charge flows into the toner accumulated on the brush surface to generate reversal toner. Thus, upon passing between the charging roller 2 and the photosensitive drum 1, a large amount of the reversal toner is deposited on the charging roller 2 and the deposited amount may exceed an amount of the reversal toner which is changed into the normal polarity by the charging roller 2 and released onto the photosensitive member.

Also a further elongated service life is intended, the deposited toner amount on the charging roller 2 eventually increases to results a charging defect, thus constituting a cause of a charging failure by the auxiliary charging brush 7.

The setting of the bias applied to the auxiliary charging brush, as already explained in the prior technology, influences the service life capable of providing a satisfactory image, in the image formation over a prolonged period. More specifically, an excessively high bias to the auxiliary charging brush 7 accelerates fog formation, while an excessively low bias accelerates ghost formation.

Figure 3:
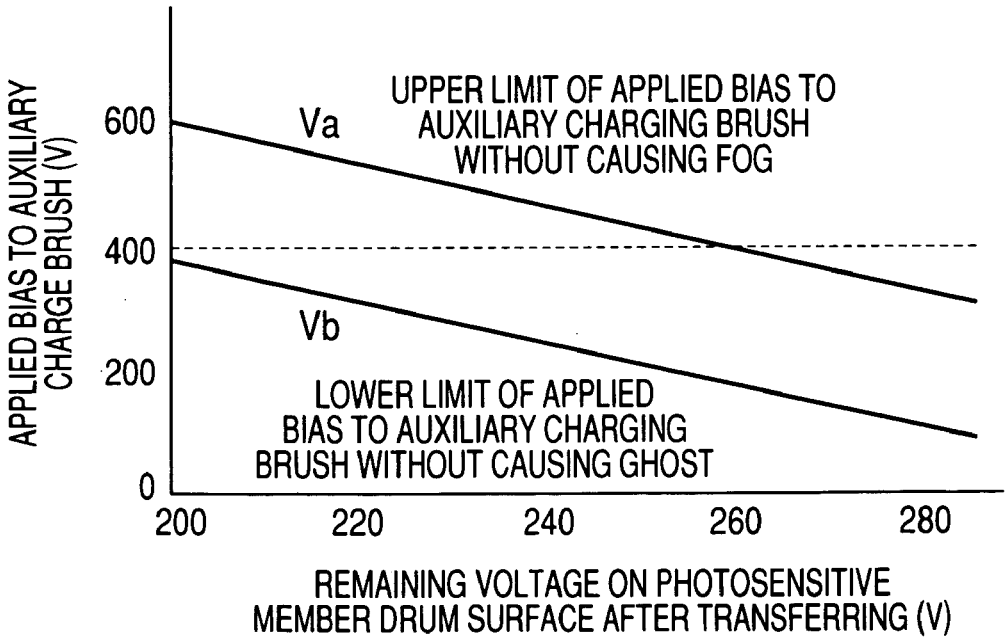
FIG. 3 is a chart showing the dependence on the residual surface potential on the surface of the image bearing member after the transfer in the auxiliary charging brush in the image forming apparatus of Example 1.

FIG. 3 is a chart showing a dependence on the residual surface potential remaining on the surface of the photosensitive drum after the transfer in the auxiliary charging brush in the present example.

In FIG. 3, Va indicates an upper limit bias to the auxiliary charging brush 7 without fog formation in case A4-sized sheets of an image proportion of 5% are passed over a prolonged period, and Vb indicates a lower limit bias to the auxiliary charging brush 7 without ghost formation. However, these indicate a case where a constant bias is applied to the auxiliary charging brush 7, and signify that, in a latter stage of a sheet-passing durability test, when the surface of the photosensitive drum 1 after the transfer tends to retain the potential of the previous image, the potential difference between the surface of the photosensitive drum 1 after the toner image transfer and the auxiliary charging brush increases thereby increasing the effect or influence of the auxiliary charging brush 7. More specifically, when the residual potential on the photosensitive drum 1 after the toner image transfer increases as a result of image formations over a prolonged period, a positive charge flows more easily from the auxiliary charging brush 7 to the photosensitive drum 1 and the toner accumulated on the brush surface, the ghost formation can be suppressed even by a small bias but the fog formation is stimulated by the increase of the reversal toner, generated by a flow of an excessive positive charge to the toner.

Figure 4:
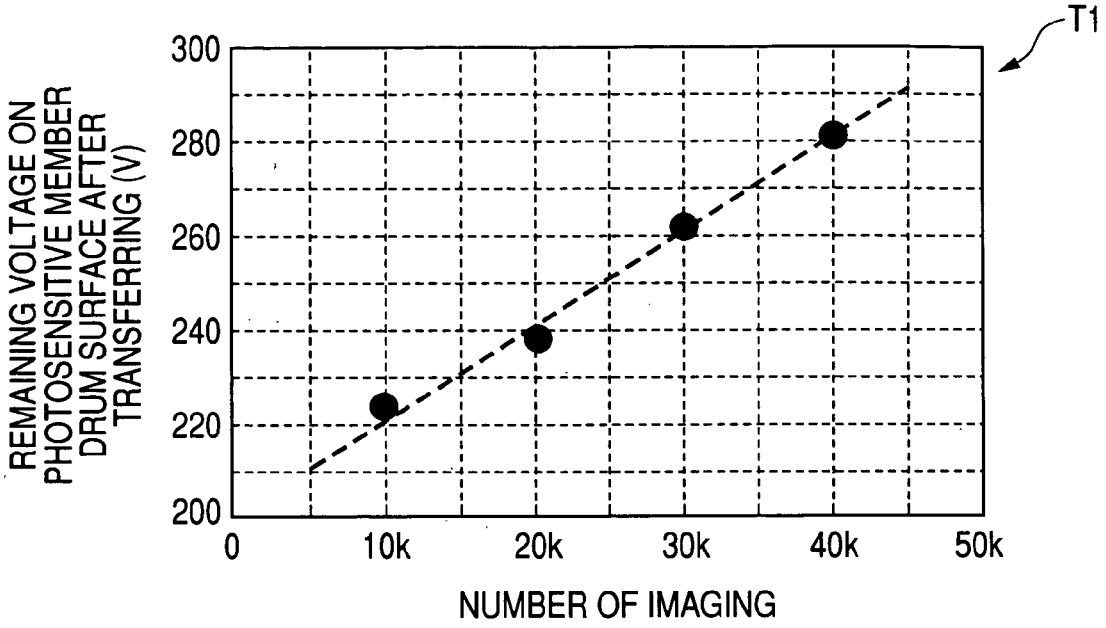
FIG. 4 is a chart of a conversion table indicating a relationship between a number of image formations and a residual surface potential on the image bearing member after the transfer in the image forming apparatus of an example 1.

In the present example, therefore, a conversion table T1 between a number of image formations and a residual surface potential remaining on the photosensitive drum as shown in FIG. 4 is employed as residual potential detecting means for detecting the residual potential on the photosensitive drum 1 after the toner image transfer, and the bias of the auxiliary charging brush 7 is changed according to the residual potential converted from the number of image formations.

Referring to FIG. 1, 11 indicates a controller constituting control means, and composed of a CPU and a memory such as a ROM and a RAM. The memory stores the conversion table T1 between the number of image formations and the residual surface potential remaining on the photosensitive drum as shown in FIG. 4. The conversion table T1 detects the residual surface potential as about 200 to 220 V for a number of image formations (number of recording materials having received the toner image transfer) of 0 to 10,000, about 220 to 240 V for 10,000 to 20,000 image formations, about 240 to 260 V for 20,000 to 30,000 image formations, about 260 to 280 V for 30,000 to 40,000 image formations, and about 280 V or higher for 40,000 to 50,000 image formations.

The controller 11 determines a total number of image formations by successively accumulating signals indicating a number of image-formations from an unillustrated image formation counter, and obtains a residual surface potential for such total number of image formations, from the aforementioned conversion table T1. Based on thus obtained residual surface potential, the bias voltage source S4 is controlled to variably regulate a bias condition to the auxiliary charging brush 7.

Table 1 shows examples of the bias to the auxiliary charging bias 7 variably regulated according to the residual potential. In Table 1, the residual potential after the transfer is divided into 5 levels within a range of 220 to 280 V, and the bias to the auxiliary charging brush 7 is set for each level.

The applied biases are set as shown in Table 1 (boundary value being included in an upper level).

TABLE 1

(K: 1,000)

| Residual potential level | Number of image formations | Residual potential after transfer | Bias to auxiliary charging brush |
|---|---|---|---|
| Level 1 | 0 to 10 K | 200 to 220 | 400 V |
| Level 2 | 10 K to 20 K | 220 to 240 | 350 V |
| Level 3 | 20 K to 30 K | 240 to 260 | 300 V |
| Level 4 | 30 K to 40 K | 260 to 280 | 250 V |
| Level 5 | 40 K to 50 K | 280 to | 200 V |

Thus, the controller 11 applies, from the bias source S4 to the auxiliary charging brush, a bias of 400 V for a residual potential after the transfer of 200 to 220 V, a bias of 350 V for a residual potential after the transfer of 220 to 240 V, a bias of 300 V for a residual potential after the transfer of 240 to 260 V, a bias of 250 V for a residual potential after the transfer of 260 to 280 V, and a bias of 200 V for a residual potential after the transfer of 280 V or higher.

Also in the present example, the voltage applied to the auxiliary charging brush is corrected according to the residual potential after the transfer varying depending on the image proportion.

Based on image information from an image processing part 204 constituting control means of the image forming apparatus, image proportion calculation means 210 (video count means) of the controller 200 calculates an image proportion, and a voltage applied to the auxiliary charging brush is determined according to a residual potential judged from thus calculated image proportion.

Figure 5:
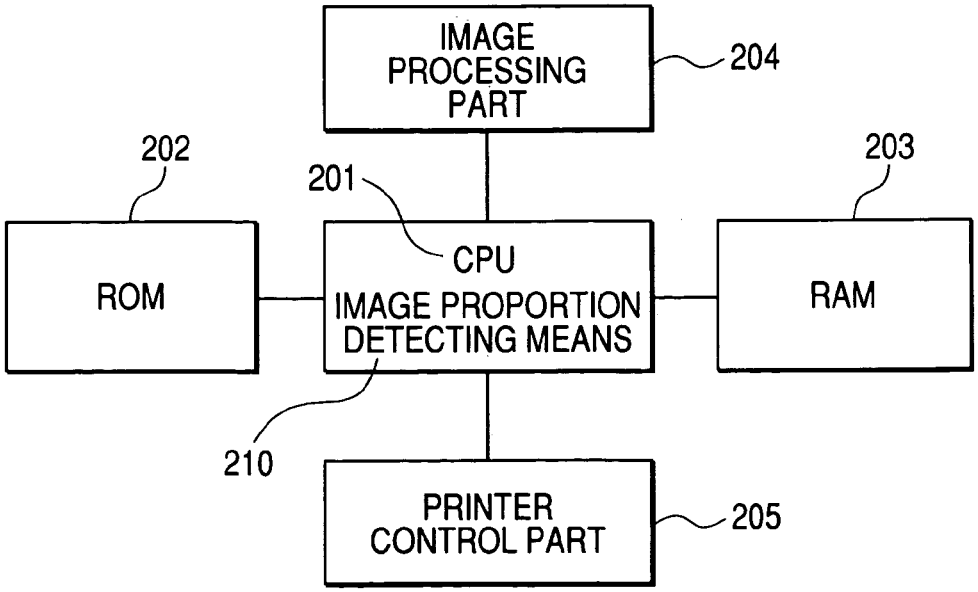
FIG. 5 is a view showing control means of a controller.

Control means of the controller 200 is shown in a block diagram in FIG. 5.

The controller 200 executes a basic control by a CPU 201 which controls an image forming operation. The CPU 201 is connected to a ROM 202 storing a control program for the image forming operation, a work RAM 203 for executing the control program, a printer control part 205 for controlling respective image forming means, and an image processing part 204 for reading image information from an original and executing image processing. The CPU 201 receives an image signal from the image processing part 204 according to the control program stored in the ROM 202 and executes an image forming operation by controlling the printer control part 205.

Thus, the image information is converted into a signal in the image processing part 204, and is transmitted as an image signal to the printer control part 205 executing the image formation. The image proportion calculation means 210 calculates an image proportion from such image signal. More specifically, in the processing of the image signal read in the image processing part 204, there is counted a number of image signal in an image, namely an amount of an image part within an image area, and the image proportion is determined by the image proportion calculation means 210.

The image proportion will be explained further. The present example employs an image proportion per unit area. More specifically, an image proportion per unit area=(total video count of image formed on a recording material)/(area of a solid image per recording material) is determined from the image proportion.

Therefore, the image proportion, taking a solid image as 100%, becomes 0% in a state without any image on the recording material. As a simplified explanation of Table 2, 5th row indicates a character image principally constituted of characters, and 3rd row indicates a photo image principally constituted of a photograph. Also 4th row indicates an image containing characters and a photograph, 2nd row indicates a denser photograph image, and 1st row indicates an image close to a solid image.

TABLE 2

| | Image proportion | | | | Potential after transfer | Correction value |
|---|---|---|---|---|---|---|
| | Bk | Y | C | M | (V) | (V) |
| 1 | 90 to 100 | 90 to 100 | 90 to 100 | 90 to 100 | −180 | 60 |
| 2 | 60 to 90 | 70 to 90 | 60 to 90 | 60 to 90 | −200 | 30 |
| 3 | 40 to 60 | 50 to 70 | 30 to 60 | 25 to 60 | −220 | 0 |
| 4 | 10 to 40 | 10 to 50 | 10 to 30 | 10 to 25 | −260 | −30 |
| 5 | 0 to 10 | 0 to 10 | 0 to 10 | 0 to 10 | −300 | −60 |

Now a relation between the image proportion and the residual potential after transfer will be explained in case of a reversal development with a negative toner. There will be explained an investigation utilizing a photosensitive drum in an early stage of a durability test in an image forming apparatus similar to that explained above. The foregoing table shows a relationship between an image proportion and a correction value for each of a black toner (Bk), a yellow toner, a cyan toner and a magenta toner. The present example provided results shown in the foregoing table, but the present invention is naturally not limited to such values.

In case of a high image proportion, where a major part of the image bearing member is exposed, an average potential in the image area prior to development is estimated as about −250 V. Therefore, the residual potential after transfer is about −180 V even under the influence of the positive transfer bias. Therefore, the voltage applied to the auxiliary charging brush is preferably selected larger than in other cases, in order to secure a potential contrast between the residual potential and the auxiliary charging brush thereby perturbing the image hysteresis. Therefore, as shown in Table 2, the correction value is set at 60 V for the case of the first row. On the other hand, in case of a lower image proportion as in a character image, an average potential in the image area prior to development is estimated as about −500 V. Therefore, the residual potential after transfer is about −300 V even under the influence of the positive transfer bias. Therefore, the voltage applied to the auxiliary charging brush is preferably selected smaller than in other cases, in order to secure a potential contrast between the residual potential and the auxiliary charging brush thereby perturbing the image hysteresis. Therefore, the correction value for the 5th row is set at −60 V.

Such correction values can be fed back to the values in Table 1 to secure an appropriate potential contact between the residual potential after transfer and the voltage applied to the auxiliary charging brush.

Figure 6:
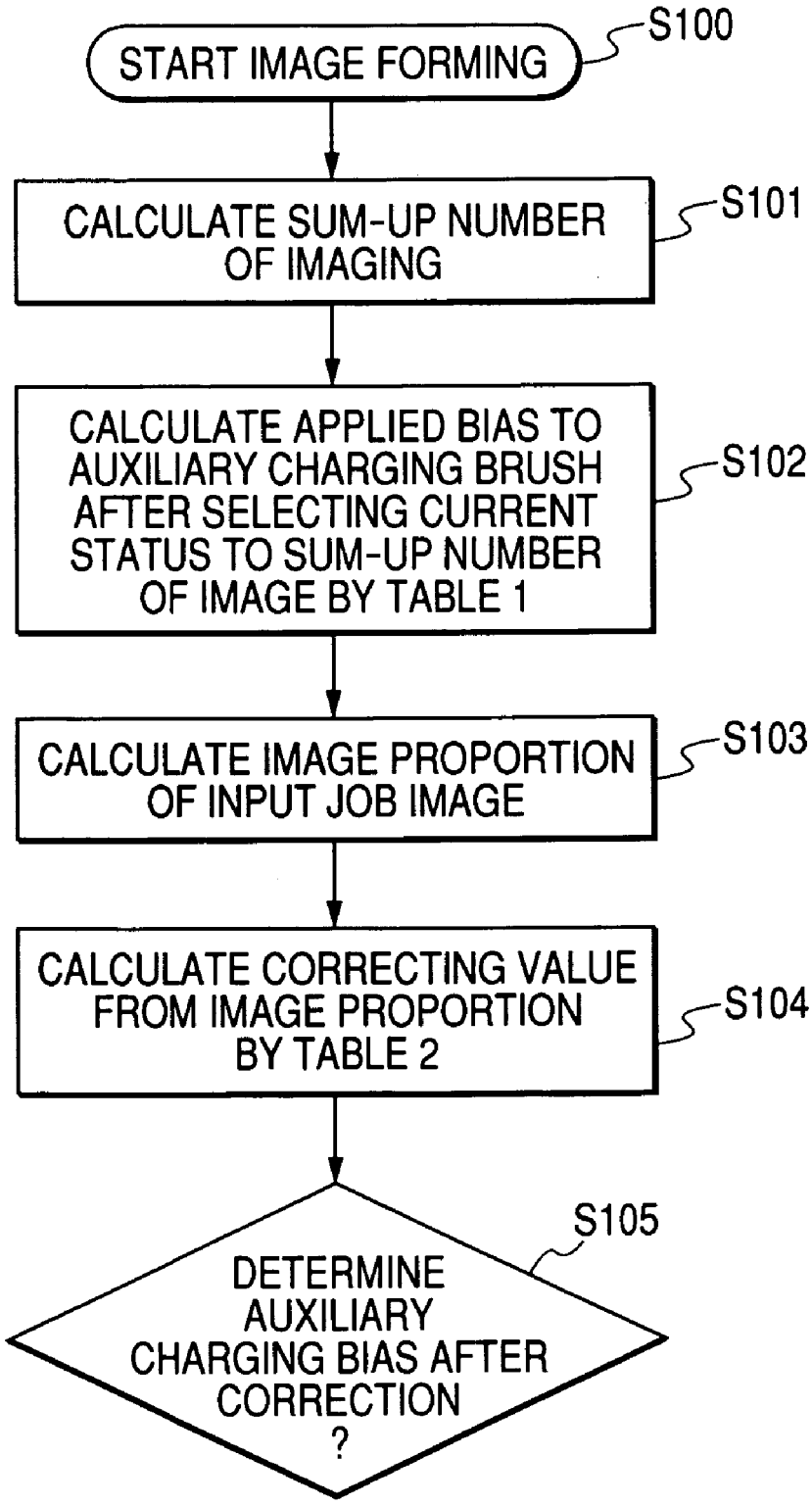
FIG. 6 is a flow chart of Example 1.

FIG. 6 shows a flow chart. At first an instruction for image formation is entered to initiate an image formation (S100). At the start of image formation, there is calculated a cumulative number of image formations stored for the current photosensitive drum (S101). Then a level is extracted from Table 1 corresponding to the current cumulative number of image formations (S102). Then an image proportion of the image to be output is calculated by the image proportion calculation means (S103). The calculated image proportion is used in Table 2 to determine a correction value for the bias to be applied to the auxiliary charging brush (S104). Then a step S105 determines a bias to the auxiliary charging brush, including such correction value.

In a sheet-passing durability test with the above-explained configuration, a satisfactory image level without fog or ghost could be maintained for 40,000 images while a constant bias of 400 V to the auxiliary charging brush 7 could only maintain such image level for 30,000 images.

EXAMPLE 2

The image forming apparatus of the present example employs, instead of the conversion table T1 between the number of image formations and the residual surface potential remaining on the photosensitive drum employed in Example 1, a conversion table T2 between a change in a discharge current and a residual surface potential remaining on the photosensitive drum, which is stored in a memory of the control part 11.

The present example assumes a case where the images formed in a sheet-passing durability test are constant in size, and, based on a relationship of a change in the discharge current flowing between the photosensitive drum 1 and the charging roller 2 from the start of the durability test and the residual surface potential on the photosensitive drum after the toner image transfer, the bias to the auxiliary charging brush 7 was changed according to a result of conversion of a change in the discharge current, detected by discharge current control means 10, into the surface residual potential on the photosensitive drum after transfer.

In the conversion table T2 stored as the residual potential detection means in the memory of the controller 11, the residual surface potential is detected as about 200 to 220 V for a change in the discharge current of 0 to 20 μA, about 220 to 240 V for a change of 20 to 40 μA, about 240 to 260 V for a change of 40 to 60 μA, about 260 to 280 V for a change of 60 to 80 μA, and about 280 V or higher for a change of 80 μA or higher.

The controller 11 determines a change in the discharge current detected by the discharge current control means 10, and obtains a residual surface potential for such change in the discharge current, from the aforementioned conversion table T2. Based on thus obtained residual surface potential, the bias voltage source S4 is controlled to variably regulate a bias condition to the auxiliary charging brush 7.

Table 3 shows examples of the bias to the auxiliary charging bias 7 variably regulated according to the residual potential. Also in Table 3, the residual potential after the transfer is divided into 5 levels within a range of 220 to 280 V, and the bias to the auxiliary charging brush 7 is set for each level.

The applied biases are set as shown in Table 3 (boundary value being included in an upper level).

TABLE 3

| Residual potential level | Change in discharge current (μA) | Residual potential after transfer | Bias to auxiliary charging brush |
|---|---|---|---|
| Level 1 | 0 to 20 | 200 to 220 | 400 V |
| Level 2 | 20 to 40 | 220 to 240 | 350 V |
| Level 3 | 40 to 60 | 240 to 260 | 300 V |
| Level 4 | 60 to 80 | 260 to 280 | 250 V |
| Level 5 | 80 to | 280 to | 200 V |

In the present example, the biases applied by the controller 11 to the auxiliary charging brush 7 through the bias source S4 are same as in Example 1.

In a sheet-passing durability test with the above-explained configuration, a satisfactory image level without fog or ghost could be maintained for 42,000 images even in case the formed images were not constant in the image proportion or in the image size.

Also in this example, the voltage applied to the auxiliary charging brush may be corrected according to the image information as shown in Table 2.

EXAMPLE 3

The image forming apparatus of the present example employs, instead of the conversion table T1 between the number of image formations and the residual surface potential remaining on the photosensitive drum employed in Example 1, a conversion table T3 between a bias voltage application time and a residual surface potential remaining on the photosensitive drum, based on a correlation between a cumulative value of a time in which a bias voltage application from the charging roller 2 to the surface of the photosensitive drum 1 and a rotation of the photosensitive drum 1 are executed simultaneously, and the residual surface potential of the photosensitive drum after the toner image transfer, changing with an increase in the aforementioned cumulative time, and such conversion table T3 is stored in the memory of the controller 11 as the residual potential detection means for detecting the residual potential on the surface of the photosensitive drum 1 after the toner image transfer.

The controller 11 determines a cumulative rotation time of the photosensitive drum during the application of the aforementioned bias voltage, and obtains a residual surface potential corresponding to such cumulative rotation time from the conversion table T3. Based on thus obtained residual surface potential, the bias voltage source S4 is controlled to variably regulate a bias condition to the auxiliary charging brush 7.

Also in this example, the voltage applied to the auxiliary charging brush may be corrected according to the image information as shown in Table 2.

EXAMPLE 4

Figure 8:
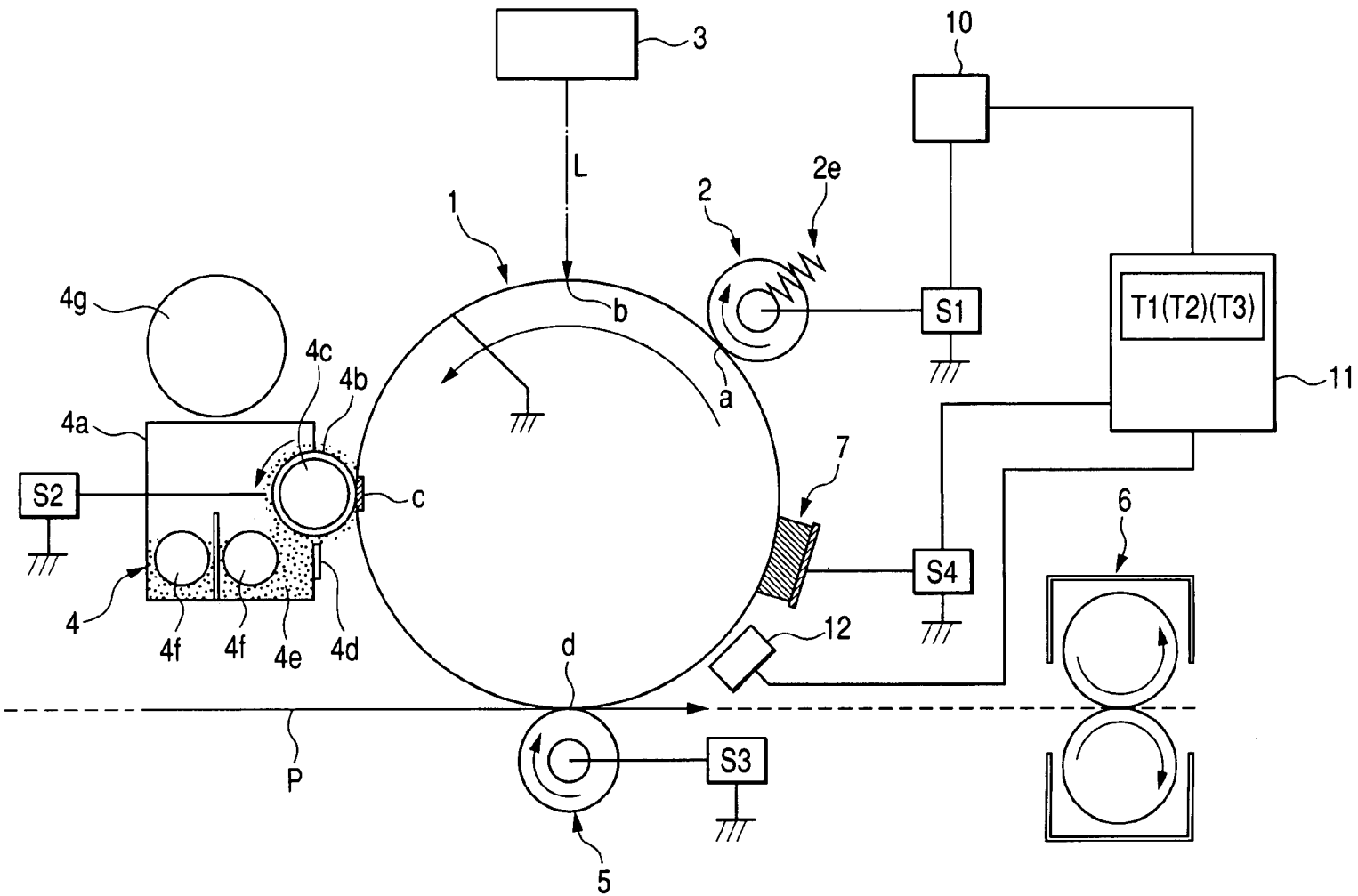
FIG. 8 is a view showing an image forming apparatus of an example 4.

The image forming apparatus of the present example is provided, in an image forming apparatus shown in FIG. 8, with a surface potential detector 12 as residual potential detecting means for detecting the residual surface potential of the photosensitive drum 1 after the toner transfer, so positioned as to be opposed to the surface of the photosensitive drum 1 as shown in FIG. 8. The surface potential detector 12 was positioned approximately corresponding to the center of the photosensitive drum.

Based on a measured value from the surface potential detector, the controller 11 controls the bias voltage source S4 so as to variably regulate a bias condition to the auxiliary charging brush 7.

TABLE 4

| Residual potential level | Residual potential after transfer (V) | Bias to auxiliary charging brush |
|---|---|---|
| Level 1 | To 220 | 400 V |
| Level 2 | 220 to 240 | 350 V |
| Level 3 | 240 to 260 | 300 V |
| Level 4 | 260 to 280 | 250 V |
| Level 5 | 280 to | 200 V |

As shown in Table 4, the bias applied to the auxiliary charging brush is determined according to the detected residual potential after the transfer. The effects of the present invention can also be obtained even in a method of determining the voltage to be applied to the auxiliary charging brush by actually measuring the residual surface potential after transfer.

Also in this example, the voltage applied to the auxiliary charging brush may be corrected according to the image information as shown in Table 2.

OTHERS

1) The charging method is not limited to the contact charging method utilizing a charging roller, but there can be utilized various contact charging methods such as brush charging.
2) The photosensitive member as the image bearing member (member to be charged) preferably has a low resistance layer with a surface of $10^9$ to $10^{14}$ Ω·cm for realizing a charge-injection charging and in preventing ozone generation, but other organic photosensitive members may also be employed. Stated differently, the contact charging is not limited to the charge-injection charging method shown in the examples but can be a contact charging system in which a discharge phenomenon is governing.
3) The developing apparatus 4 has been explained as employing a two-component contact developing method, but other developing methods may also be employed. Preferably, a one-component contact development or a two-component contact development in which a latent image is developed by contacting a developer with a photosensitive member is effective for stimulating the developer recovery simultaneous with development. Also the developing apparatus may be of a reversal development method or a normal development method.
4) In case an AC component (alternating voltage or AC voltage) is added to the bias applied to the charging apparatus 2 or the developing apparatus 4, such AC component may have a suitable wave form such as a sinusoidal wave, a square wave or a triangular wave. It can also be a rectangular wave formed by periodically turning on/off a DC power source. Thus, there can be utilized, as a bias, an alternating voltage having a periodically varying wave form.
5) An image forming process to be used in the image forming apparatus is not limited to those employed in the examples but can be any process. A recording medium receiving the transfer of the toner image from the image bearing member can also be an intermediate transfer member such as an intermediate transfer drum or an intermediate transfer belt. In such case, in the (number of image formations)-(residual surface potential of photosensitive drum) conversion table T1, the number of image formations can be replaced by a number of toner image transfers from the image bearing member to the intermediate transfer member.
6) The image exposure means for forming an electrostatic latent image is not limited to the laser scan exposure means in the examples, but any means capable of forming an electrostatic latent image corresponding to the image information, such as an ordinary analog image exposure apparatus, an apparatus employing another light emitting element such as an LED, or an apparatus utilizing a combination of a light emitting device such as a fluorescent lamp and a liquid crystal shutter.
7) The image bearing member can also be an electrostatic recording dielectric member. In such case, an electrostatic latent image of image information is formed by uniformly charging a surface of the dielectric member at predetermined polarity and potential, and executing a selective charge elimination with charge eliminating means such as a charge eliminating needle head or an electron gun.

8) The transfer means is not limited to the transfer roller in the examples but can be arbitrarily selected such as a corona charger (corona discharge transfer), a transfer belt apparatus, a conductive brush or a conductive blade.

As explained in the foregoing, the present invention can prevent an image defect resulting from a voltage applied to the auxiliary charging means, regardless of a fluctuation of the potential of the photosensitive member after the image transfer.

The present invention has been explained by examples thereof, but the present invention is not limited to such examples and is subject to any and all modifications within the technical concept of the present invention.

This application claims priority from Japanese Patent Application No. 2003-427810 filed Dec. 24, 2003, which is hereby incorporated by reference herein.

What is claimed is:

1. An image forming apparatus comprising:

an image bearing member;

charging means which is in contact with the image bearing member and charges the image bearing member;

development means which forms a toner image on the image bearing member and recovers a residual toner remaining after the transfer from the image bearing member;

transfer means which transfers the toner image on the image bearing member onto a transfer material;

auxiliary charging means which is positioned at a downstream side of the transfer means and at an upstream side of the charging means in a rotating direction of the image bearing member, which is in contact with the image bearing member and which is given a voltage of a polarity opposite to that of the developing toner; and voltage selecting means which selects the voltage applied to the auxiliary charging means based on the potential of the image bearing member after the transfer.

2. An image forming apparatus according to claim 1, wherein the voltage selecting means selects a smaller voltage applied to the auxiliary charging means, for a larger potential on the image bearing member after the transfer.

3. An image forming apparatus according to claim 1, wherein the potential of the image bearing member after the transfer is detected from a state of use of the image bearing member.

4. An image forming apparatus according to claim 1, wherein the potential of the image bearing member after the transfer is detected from image information of an image to be output.

5. An image forming apparatus according to claim 1, wherein the voltage applied to the auxiliary charging means is increased when an amount of image information increases.

6. An image forming apparatus according to claim 1, further comprising potential detection means for detecting a potential of the image bearing member after the transfer, wherein the voltage selecting means sets a voltage to be applied to the auxiliary charging means based on an output of the potential detection means.

7. An image forming apparatus according to claim 1, wherein the auxiliary charging brush is a fur brush.

8. An image forming apparatus comprising:

an image bearing member;

charging means which is in contact with the image bearing member and charges the image bearing member;

development means which forms a toner image on the image bearing member and recovers a residual toner remaining after the transfer from the image bearing member;

transfer means which transfers the toner image on the image bearing member onto a transfer material;

auxiliary charging means which is positioned at a downstream side of the transfer means and at an upstream side of the charging means in a rotating direction of the image bearing member, which is in contact with the image bearing member and which is given a voltage of a polarity opposite to that of the developing toner; and voltage selecting means which selects the voltage applied to the auxiliary charging means based on image information to be output.

9. An image forming apparatus according to claim 8, wherein the voltage applied to the auxiliary charging means is increased when an amount of image information increases.

10. An image forming apparatus according to claim 8, wherein the image information is detected by a video count value.

11. An image forming apparatus according to claim 8, wherein the auxiliary charging brush is a fur brush.

* * * * *